US011217896B2

(12) United States Patent
Legay et al.

(10) Patent No.: US 11,217,896 B2
(45) Date of Patent: Jan. 4, 2022

(54) CIRCULARLY POLARISED RADIATING ELEMENT MAKING USE OF A RESONANCE IN A FABRY-PEROT CAVITY

(71) Applicants: THALES, Courbevoie (FR); INSTITUT NATIONAL DES SCIENCES APPLIQUEES, Rennes (FR); UNIVERSITE DE RENNES 1, Rennes (FR); CENTRE NATIONAL DE LA RECHERCHE SCIENTIFIQUE, Paris (FR)

(72) Inventors: Hervé Legay, Plaisance du Touch (FR); Antoine Calleau, Cesson Sevigne (FR); Maria Garcia Vigueras, Rennes (FR); Mauro Ettorre, Rennes (FR)

(73) Assignees: THALES, Courbevoie (FR); INSTITUT NATIONAL DES SCIENCES APPLIQUES, Rennes (FR); UNIVERSITE DE RENNES 1, Rennes (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 184 days.

(21) Appl. No.: 16/367,085

(22) Filed: Mar. 27, 2019

(65) Prior Publication Data

US 2019/0305436 A1 Oct. 3, 2019

(30) Foreign Application Priority Data

Mar. 29, 2018 (FR) ..... 1800260

(51) Int. Cl.
*H01Q 15/24* (2006.01)
*H01Q 19/10* (2006.01)
(Continued)

(52) U.S. Cl.
CPC ..... *H01Q 15/24* (2013.01); *H01Q 5/28* (2015.01); *H01Q 15/0013* (2013.01);
(Continued)

(58) Field of Classification Search
CPC .. H01Q 15/24; H01Q 15/244; H01Q 15/0013; H01Q 15/0026; H01Q 19/104; H01Q 5/28
See application file for complete search history.

(56) References Cited

U.S. PATENT DOCUMENTS 3,001,193 A * 9/1961 Marie ..... H01Q 21/24 342/365
2011/0163930 A1* 7/2011 De Lustrac ..... H01Q 15/148 343/777
2013/0207859 A1* 8/2013 Legay ..... H01Q 15/24 343/756

FOREIGN PATENT DOCUMENTS

EP 2 827 444 A2 1/2015
WO 2011/134666 A1 11/2011

OTHER PUBLICATIONS

Orr, et al., "Design Method for Circularly Polarized Fabry-Perot Cavity Antennas", IEEE Transactions on Antennas and Propagation, vol. 62, Issue: 1, pp. 19-26, Jan. 2014.
(Continued)

*Primary Examiner* — Hai V Tran
*Assistant Examiner* — Michael M Bouizza
(74) *Attorney, Agent, or Firm* — BakerHostetler

(57) ABSTRACT

A circularly polarized radiating element includes at least one excitation aperture for a wave that is linearly polarized with what is referred to as an excitation first polarization, a frequency selective surface and a metasurface comprising a two-dimensional and periodic array of metasurface cells, the excitation aperture opening onto the metasurface, the metasurface cells all being oriented identically with respect to the
(Continued)

excitation polarization and configured to: reflect an incident wave having the excitation polarization in order to form a reflected wave polarized with the excitation polarization, and depolarize and reflect the incident wave in order to form a reflected wave polarized with the orthogonal polarization, having a phase difference substantially equal to ±90° with respect to the reflected wave polarized with the excitation polarization, and having an amplitude substantially equal to the amplitude of a wave radiated by the frequency selective surface, generated from the reflected wave polarized with the excitation polarization.

16 Claims, 8 Drawing Sheets

(51) Int. Cl.
*H01Q 5/28* (2015.01)
*H01Q 15/00* (2006.01)

(52) U.S. Cl.
CPC ..... *H01Q 15/0026* (2013.01); *H01Q 15/244* (2013.01); *H01Q 19/104* (2013.01)

(56) References Cited

OTHER PUBLICATIONS

Muhammad, et al., "Self-Polarizing Fabry-Perot Antennas Based on Polarization Twisting Element", IEEE Transactions on Antennas and Propagation, vol. 61, No. 3, pp. 1032-1040, Mar. 2013.
Pourhosseni, et al., "Self-Polarizing Highly-Gain Fabry-Perot Cavity Antennas with EDR Unit Cell", pp. 138-146, Dec. 3, 2014.

* cited by examiner

CIRCULARLY POLARISED RADIATING ELEMENT MAKING USE OF A RESONANCE IN A FABRY-PEROT CAVITY

CROSS-REFERENCE TO RELATED APPLICATIONS

This application claims priority to foreign French patent application No. FR 1800260, filed on Mar. 29, 2018, the disclosure of which is incorporated by reference in its entirety.

FIELD OF THE INVENTION

The invention relates to a circularly polarized radiating element, in particular for a planar antenna, intended to be used in particular in space communications, on board satellites or in user terminals. The invention also relates to an array antenna comprising at least one such radiating element.

BACKGROUND

Various types of radiating elements have recently been developed, which meet the constraints and specificities of space communications.

Radiating elements of the type said to be "compact", such as for example Fabry-Perot resonator antennas, in particular allow a good compromise to be achieved between a number of specifications: a good effective aperture in the entire operating band, sufficiently wide matching and emission passbands, a low bulk and a low mass. Bulk is particularly critical in low-frequency bands: L band (1 to 2 GHz), S band (2 to 4 GHz) and C band (from 3.4 to 4.2 GHz in reception and from 5.725 to 7.075 GHz in emission), which are penalized by significant wavelengths. Thus, compact wideband elements are being sought in a particularly active way for multispot antennas, which combine a reflector and a focal array made up of many sources. The Fabry-Perot resonator antennas currently used in space communications are linearly polarized. To obtain a circular polarization with such antennas, a device allowing a circularly polarized emission to be obtained must be added without degrading the compactness of the radiating element.

Radiating elements that have continuous linear radiating apertures, such as for example quasi-optical beamformers, for their part allow a plurality of planar wavefronts to be radiated over a large angular sector. They are formed from a parallel-plate waveguide terminated by a longitudinal horn that forms the transition between the parallel-plate waveguide and free space. A focusing/collimator device is inserted on the propagation path of the radiofrequency waves, between the two metal parallel plates, allowing the cylindrical wavefronts generated by the sources to be converted into planar wavefronts. These continuous linear radiating apertures operate over a very wide band (for example at 20 and at 30 GHz) because of the absence of resonant propagating modes. They are moreover capable of radiating over a very large angular sector. However, in nominal operation the polarization of the radiated wave is that of the wave that propagates through the parallel-plate waveguide, namely a linear polarization.

To obtain identical beam widths in two planes, it is moreover known to enlarge the continuous linear radiating aperture using a parallel-plate divider. These arrays of linear apertures also radiate in linear polarization, just like each linear radiating aperture.

There is therefore currently a need to develop devices that are capable of converting a linear polarization into circular polarization, that are compatible with existing radiating apertures and that are moreover able to function as a circularly polarized radiating element.

A first known solution consists in covering the radiating element with a polarizing radome made up of a plurality of frequency selective surfaces (FSS), the characteristics of which are optimized so as to generate a phase difference of 90° between the two orthogonal polarizations, without disrupting the operation of the antenna. Polarizing radomes in which quarter wave layers are arranged in cascade perform well in terms of passband and at oblique angles of incidence but are thick (thickness of the order of one wavelength in vacuum), decreasing the compactness of the antenna. Thin polarizers have also been developed, but their performance in terms of passband and at oblique angles of incidence is limited.

One solution consisting in combining a polarizer and a Fabry-Perot cavity is described in document "Self polarizing Fabry-Perot antennas based on polarization twisting element" (S. A. Muhammad, R. Sauleau, G. Valerio, L. L. Coq, and H. Legay, IEEE Trans. Antennas Propag., vol. 61, no. 3, pp. 1032-1040, Mar. 2). The solution is illustrated in FIG. 1. The FSS Fabry-Perot cavity radiates similarly in two subspaces (an upper subspace and a lower subspace). The cavity is formed by two periodic surfaces (FSS1, FSS2) that partially reflect a linear polarization Ex, and is excited with this polarization. The periodic surfaces are transparent to the wave Ey. A polarization-inverting ground plane reflects the wave transmitted into the lower plane, converts its linear polarization (for example from Ex to Ey), and returns the wave upwards. This ground plane PM is produced by means of corrugations COR of $\lambda/4$ depth, which are inclined by 45° with respect to the grids forming the partially reflected periodic surfaces (FSS1, FSS2). A distance of $\lambda/8$ (where $\lambda$ is the wavelength in the radiating element) between the polarization-inverting ground plane PM and the Fabry-Perot cavity (two surfaces of which are periodic and partially reflective) generates a phase delay of 90° in the component Ey, which delay is required to obtain the circular polarization. Since the cavity is transparent to the component Ey, the field is radiated into the upper subspace. The frequency behaviour of this solution is however relatively narrow band. Specifically, as illustrated in FIG. 4 of the cited document, the axial ratio of the wave output from the polarizer is 1 dB in a frequency band corresponding to about 2.5% of the central frequency. This narrow-band behaviour is related on the one hand to the corrugations of the ground plane PM, the height ($\lambda/4$) of which is wavelength-dependent. It is also related to the spacing ($\lambda/8$) between the partially reflective lower periodic surface FSS1 and the ground plane PM, which is wavelength-dependent.

SUMMARY OF THE INVENTION

The invention therefore aims to obtain a radiating element that is compact heightwise, very wideband and that is able to generate a circular polarization from a linear excitation.

One subject of the invention is therefore a circularly polarized radiating element comprising:

- at least one excitation aperture for a wave that is linearly polarized with what is referred to as an excitation first polarization; and
- a frequency selective surface that partially reflects the excitation polarization and that is transparent to a second polarization, referred to as the orthogonal polarization, that is orthogonal to the excitation polarization and to the direction of propagation of the wave, said surface being placed in a plane defined by the excitation polarization and by the orthogonal polarization;

the radiating element furthermore comprising a completely reflective metasurface facing the frequency selective surface, and comprising a two-dimensional and periodic array of conductive planar elements forming metasurface cells, the excitation aperture opening onto the metasurface, the frequency selective surface and the metasurface forming a resonant cavity for the excitation polarization, the metasurface cells all being oriented identically with respect to the excitation polarization and configured to:

reflect an incident wave having the excitation polarization in order to form a reflected wave polarized with the excitation polarization, and depolarize and reflect the incident wave in order to form a reflected wave polarized with the orthogonal polarization, having a phase difference substantially equal to ±90° with respect to the reflected wave polarized with the excitation polarization, and having an amplitude substantially equal to the amplitude of a wave radiated by the frequency selective surface, generated from the reflected wave polarized with the excitation polarization.

Advantageously, the metasurface comprises a ground plane on which are placed a substrate and the array of metasurface cells, which cells are arranged in rows, the centres of each metasurface cell of a given row being aligned along an alignment axis, the alignment axis being oriented by a rotation angle (Ψ) with respect to the excitation polarization, the rotation angle (Ψ) being defined so as to make the matrix [S'] diagonal, where:

$$[S']={}^{t}[R][S][R],$$

[S] being the scattering matrix of the metasurface, and [R] the rotation matrix of a rotation of angle ψ.

Advantageously, the metasurface cells of a given row are coupled by a metasurface interconnect line that is elongate along the alignment axis.

Advantageously, the rows are connected to one another by way of metasurface cells, forming with the metasurface interconnect lines a rectangular grid.

As a variant, the metasurface cells of a given row are mutually isolated.

Advantageously, the metasurface cells of a given row are all periodically spaced.

Advantageously, all the metasurface cells of the metasurface have the same dimensions.

Advantageously, the frequency selective surface comprises an array of parallel metal wires that are periodically spaced and aligned with the excitation polarization.

As a variant, the frequency selective surface comprises a two-dimensional array of metal dipoles that are arranged periodically.

Advantageously, the excitation aperture comprises at least one waveguide aperture opening into the resonant cavity.

Advantageously, the excitation aperture comprises a dual feed formed by two waveguides that open symmetrically into the resonant cavity, and that are connected to an impedance matching network.

Advantageously, the excitation aperture is a horn of a linear radiating aperture.

Advantageously, the radiating element comprises a plurality of excitation apertures, the excitation apertures being formed by an array of linear radiating apertures.

Advantageously, the radiating element comprises at least one second cavity arranged in cascade on the frequency selective surface.

Advantageously, the metasurface cells are of rectangular shape.

The invention also relates to an array antenna comprising at least one aforesaid radiating element.

BRIEF DESCRIPTION OF THE DRAWINGS

Other features, details and advantages of the invention will become apparent on reading the description given with reference to the appended drawings, which are given by way of example and show, respectively.

DETAILED DESCRIPTION

Figure 1:
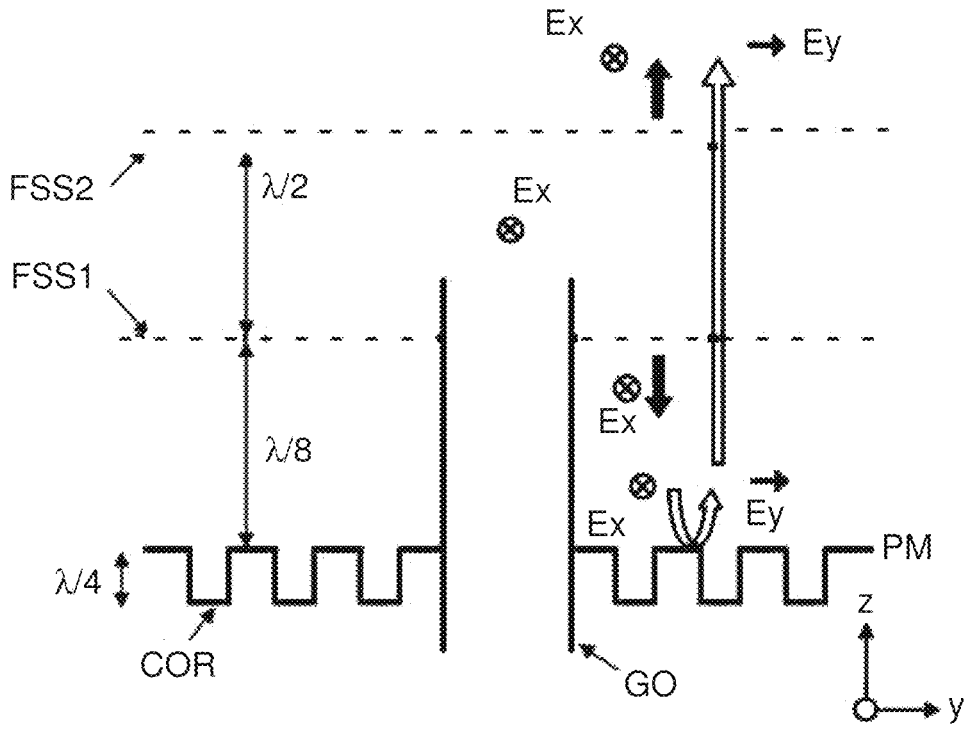
FIG. 1, a prior-art circularly polarized radiating element.
Figure 2:
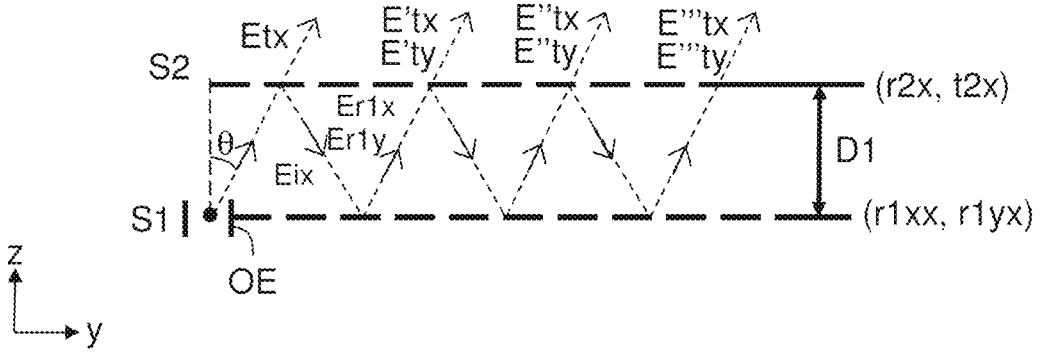
FIG. 2, a schematic representation, in the yz plane, of the radiating element according to the invention, based on ray theory.

FIG. 2 illustrates a schematic representation, in the yz plane, of the radiating element according to the invention, based on ray theory. The radiating element comprises a excitation aperture OE that opens into a metasurface S1. The metasurface S1 comprises an array of conductive planar elements that form metasurface cells (not shown in FIG. 1), having a certain pattern that is repeated periodically two dimensionally. The metasurface cells have dimensions smaller than the operating wavelength of the radiating element (so-called sub-lambda dimensions).

A wave polarized linearly with a first excitation polarization is produced in the excitation aperture OE. The excitation aperture OE is represented by a rectangular waveguide that penetrates the metasurface S1 but that does not extend beyond the metasurface S1, or if it does extends therebeyond only slightly. The linearly polarized wave propagates into the cavity, which is bounded by the metasurface S1 and by a frequency selective surface S2 comprising an arrangement of metal wires or dipoles that have a periodic distribution. The metasurface S1 and the frequency selective surface S2 are spaced apart from each other by a distance D1. The frequency selective surface S2 partially reflects the excitation polarization Ex (also called the transverse-electric (TE) polarization) and is transparent to a second polarization Ey, referred to as the orthogonal polarization (also called the transverse-magnetic (TM) polarization), that is orthogonal to the excitation polarization Ex and to the direction of propagation of the wave. The frequency selective surface S2 is therefore characterized by reflection and transmission coefficients $r_{2x}$ and $t_{2x}$, respectively. The wave produced by the excitation aperture is partially radiated (Etx) and partially reflected. The reflected portion is called the incident wave Eix The metasurface S1 is completely reflective. It acts as a ground plane, facing the frequency selective surface S2. The metasurface S1 is characterized by reflection coefficients $r_{1xx}$ and $r_{1yx}$, respectively, which express the components of the reflected wave with the polarizations Ex and Ey, resulting from the incident wave Eix.

A resonance of the type typically observed in Fabry-Perot resonators is established between the two surfaces for the wave having the excitation polarization Ex. The incident wave Eix, which propagates through the cavity, undergoes a series of reflections from the frequency selective surface S2 and from the metasurface S1. On each reflection from the frequency selective surface S2, some of the incident wave Eix is radiated. On each reflection from the metasurface S1, one portion of the incident wave Eix undergoes a rotation of polarization, also referred to as a depolarization, producing a polarized wave Er1*y* having the orthogonal polarization Ey. The amplitude of the polarized wave Er1*y* having the orthogonal polarization Ey is determined by the reflection coefficient $r_{1yx}$. Another portion of the incident wave Eix preserves its polarization, producing a polarized wave Er1*x* having the excitation polarization Ex. The amplitude of the polarized wave Er1*x* having the excitation polarization Ex is determined by the reflection coefficient $r_{1xx}$. A circularly polarized emission is obtained when the wave E'tx radiated by the frequency selective surface S2, and generated from the polarized reflected wave Er1*x* having the excitation polarization Ex, corresponds in amplitude to the polarized wave Er1*y* having the orthogonal polarization Ey, with a phase shift of ±90°. The amplitude of the wave E'tx radiated by the frequency selective surface S2 is determined by the transmission coefficient $t_{2x}$. Since the frequency selective surface S2 is transparent to the orthogonal polarization Ey, the polarized wave Er1*y* having the orthogonal polarization Ey is radiated without being attenuated. The polarized wave Er1*y* having the orthogonal polarization Ey is denoted E'ty. A first circularly polarized emission is therefore composed of the waves E'tx and E'ty.

The reflected wave Er1*x* undergoes a new reflection from the frequency selective surface S2, with a reflection coefficient $r_{2x}$, and, according to the same principle, a second circularly polarised emission is composed of the waves E"tx and E"ty, then a third circularly polarized emission, composed of the waves E'"tx and E'"ty.

Thus, a circularly polarized beam that is increasingly attenuated with distance from the excitation aperture OE is obtained.

This radiating element may be pre-dimensioned on the basis of ray theory, which is conventionally used for this category of radiating element. It is assumed that:

the size of the cavity is infinite in the xy plane;

the frequency selective surface S2 is characterized respectively by reflection and transmission coefficients $r_{2x}$ and $t_{2x}$. It is completely transparent to the polarised wave Ey;

the distance between the frequency selective surface S2 and the metasurface S1 is equal to D1, the metasurface S1 is respectively characterized by the reflection coefficients $r_{1xx}$ and $r_{1yx}$, expressing the components of the reflected wave with the polarizations Ex and Ey resulting from an incident wave Eix.

It follows from the above that, in the far field, the transfer functions $T_x$ and $T_y$ of the polarised transmitted waves $E_{trans}$ (x) and $E_{trans}$ (y) may be written as the sum of all the transmitted fields:

$$T_x = \frac{E_{trans}(x)}{E_{inc}} = [E_{tx} + E'_{tx} + E''_{tx} + \dots] \tag{1}$$

$$T_y = \frac{E_{trans}(y)}{E_{inc}} = [E'_{ty} + E''_{ty} + \dots] \tag{2}$$

$$\text{where } E_{inc} = 1$$

From (1) the transfer function $T_x$ may be determined:

$$T_x = t_{2x} + t_{2x} r_{1xx} r_{2x} e^{-jk_0(2D_1)\cos(\theta)} + t_{2x} r_{1xx}^2 r_{2x}^2 e^{-jk_0(4D_1)\cos(\theta)} + \dots \tag{3}$$

where $k_0$ is the wave number in free space, namely $2\pi/\lambda_0$, and θ the angle of incidence of the excitation wave.

$$T_x = t_{2x} \sum_{n=0}^{\infty} (r_{1xx} r_{2x})^n e^{-jk_0(2nD_1)\cos(\theta)} \tag{4}$$

$$T_x = \frac{t_{2x}}{1 - r_{1xx} r_{2x} e^{-jk_0(2D_1)\cos(\theta)}} \tag{5}$$

From (2) the transfer function $T_y$ may be determined:

$$T_y = r_{2x} r_{1yx} e^{-jk_0(2D_1)\cos(\theta)} + r_{2x}^2 r_{1xx} r_{1yx} e^{-jk_0(4D_1)\cos(\theta)} + r_{2x}^3 r_{1xx}^2 r_{1yx} e^{-jk_0(6D_1)\cos(\theta)} + \dots \tag{6}$$

$$T_y = r_{1yx} r_{2x} e^{-jk_0(2D_1)\cos(\theta)} \sum_{n=0}^{\infty} (r_{1xx} r_{2x})^n e^{-jk_0(2nD_1)\cos(\theta)} \tag{7}$$

$$T_y = \frac{r_{1yx} r_{2x} e^{-jk_0(2D_1)\cos(\theta)}}{1 - r_{1xx} r_{2x} e^{-jk_0(2D_1)\cos(\theta)}} \tag{8}$$

The condition for resonance is met when:

$$\angle r_{1xx} + \angle r_{2x} + 2N\pi = 2k_0 D_1 \cos(\theta) \tag{9}$$

where $\angle r_{1xx}$ is the phase component of the reflection coefficient $r_{1xx}$, $\angle r_{2x}$ is the phase component of the reflection coefficient $r_{2x}$, and N is any integer.

Using the transfer functions calculated with (5) and (8) for the two polarizations, it is possible to calculate the axial ratio (AR) for the whole antenna, using the following relationship:

$$AR = \frac{\sqrt{G + \sqrt{G^2 - 4\sin^2(\varphi)}}}{\sqrt{G - \sqrt{G^2 - 4\sin^2(\varphi)}}} \tag{10}$$

where:

$$G = \rho_L + \frac{1}{\rho_L} \tag{11}$$

$$\varphi = \angle T_x - \angle T_y \tag{12}$$

$$\rho_L = \frac{|T_x|}{|T_y|} \tag{13}$$

Starting with relationships (12) and (13), and using the transfer functions calculated with (5) and (8), it is therefore possible to write the condition of production of a pure circular polarization with the following relationships:

$$|t_{2x}| = |r_{1yx} r_{2x}| \tag{14}$$

$$\angle t_{2x} = \angle r_{1yx} + \angle r_{2x} - 2k_0 D_1 \cos(\theta) + \frac{\pi}{2} + 2N\pi \tag{15}$$

By combining equation (9), which describes the condition for resonance, and equation (15), which describes the condition for circular polarization, the following relationship may be obtained:

$$\angle t_{2x} = \angle r_{1yx} - \angle r_{1xx} + \frac{\pi}{2} + 2N'\pi \tag{16}$$

where N' is any integer.

Equation (16) does not depend to the first order on frequency (the wave number $k_0$ is not found in the equation), but solely relates the components of the reflection and transmission matrices of the frequency selective surface S2 and of the metasurface S1. The passband is no longer limited by the mechanism of generation of the circular polarization, but by the operating mechanism of the Fabry-Perot cavity. Techniques for widening the passband of the latter may thus be used, without affecting the circular polarization. In particular, arranging a second cavity in cascade above the frequency selective surface S2 allows the passband to be widened without degrading the quality of the circular polarization.

The phase component of the transmission coefficient $t_{2x}$ of the frequency selective surface S2 sets the directivity of the radiating element; it is therefore preset and known, depending on the desired directivity. Thus, from equation (16), to produce a pure circular polarization, all that is required is to suitably select the phase components of the reflection coefficients $r_{1yx}$ and $r_{1xx}$.

The scattering matrix [S] of the metasurface S1 may be written in the conventional way in the form:

$$[S] = \begin{bmatrix} r_{1xx} & r_{1xy} \\ r_{1yx} & r_{1yy} \end{bmatrix}$$

However, the metasurface S1 receives no incident wave of orthogonal polarization Ey, in so far as the frequency selective surface S2 is transparent to the orthogonal polarization. The reflection coefficients $r_{1xy}$ and $r_{1yy}$, which respectively express the reflection coefficient of the excitation polarisation Ex and of the orthogonal polarisation Ey for an incident wave of orthogonal polarisation Ey, may therefore be neglected when dimensioning the metasurface S1. Only the reflection coefficients $r_{1xx}$ and $r_{1yx}$ need be taken into consideration when dimensioning the metasurface S1, and are determined from relationship (16).

A coordinate system Ox'y'z is defined as being the result of the rotation by an angle Ψ about the axis Oz of the coordinate system Oxyz (the axis Ox is defined by the excitation polarization Ex, and the axis Oy by the orthogonal polarization Ey).

It is therefore sought to obtain, from the scattering matrix [S] in the coordinate system Oxyz, a diagonal scattering matrix [S'] in the coordinate system Ox'y'z able to be written in the form:

$$[S'] = \begin{bmatrix} e^{j\varphi_1} & 0 \\ 0 & e^{j\varphi_2} \end{bmatrix} \tag{17}$$

where the diagonal reflection coefficients $e^{j\varphi_1}$ and $e^{j\varphi_2}$ respectively represent the phase components of the waves respectively reflected with the excitation polarisation and with the orthogonal polarisation, in the coordinate system Ox'y'z. The amplitude components of the waves reflected with the excitation polarization and with the orthogonal polarization are equal to 1, expressing the lossless character of the metasurface S1.

Under the condition of normal incidence (θ=0°, there is thus a congruence relationship between the scattering matrix [S] in the plane Oxy, and the scattering matrix [S'] in the plane Ox'y', which may therefore be written in the form:

$$[S'] = {}^t[R][S][R] \tag{18}$$

where [R] is the rotation matrix of a rotation of angle Ψ:

$$[R] = \begin{bmatrix} \cos(\Psi) & \sin(\Psi) \\ -\sin(\Psi) & \cos(\Psi) \end{bmatrix}$$

It is therefore necessary to identify the angle Ψ that allows the required scattering matrix [S] to be converted into a diagonal matrix. For this calculation, which is not detailed here, only the reflection coefficients $r_{1xx}$ and $r_{1yx}$ have an effect on the operation of the antenna, the reflection coefficients $r_{1xy}$ and $r_{1yy}$ merely being fitting coefficients. Thus, once the angle Ψ required to obtain a diagonal matrix has been identified, the diagonal reflection coefficients $e^{j\varphi_1}$ and $e^{j\varphi_2}$ are determined from relationships (17) and (18).

Because of the misalignment of the metasurface S1 with respect to the excitation polarization Ex, each linearly polarized incident wave is reflected with a component of excitation polarization Ex and with a component of orthogonal polarization Ey. In the case of a metasurface S1 consisting of an arrangement of rectangular conductive planar elements (or "patches"), the phase response as a function of the polarization Ex or Ey is controlled to the first order by the dimensions of the conductive planar element.

Figure 3:
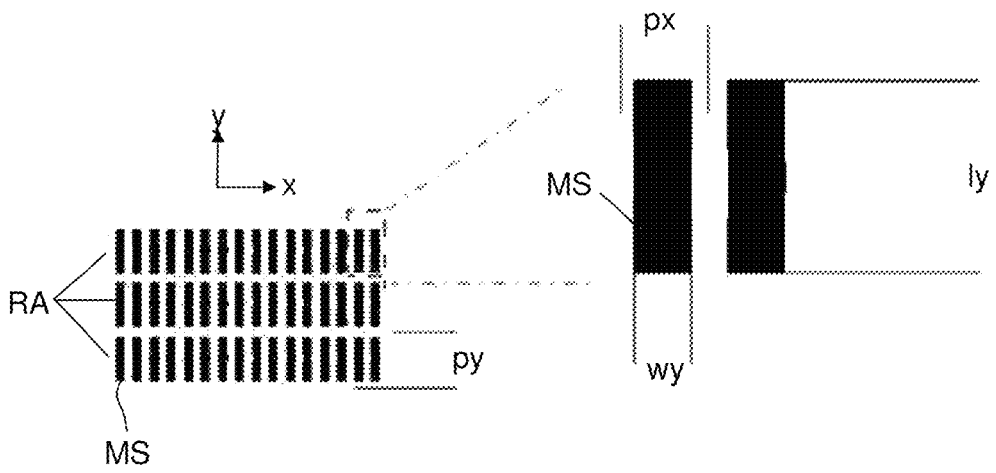
FIG. 3, an overview and a detail view, in the xy plane, of a plurality of rows of metasurface cells of the metasurface, said cells being mutually isolated.

The metasurface S1 may comprise an array of metasurface cells MS such as illustrated in FIG. 3. The dimensions of the metasurface cells MS may be obtained relatively independently depending on the phase components of the diagonal reflection coefficients. Thus, the dimensions of each metasurface cell MS (length ly and width wy) are adjusted depending on the phase components of the previously determined diagonal reflection coefficients $e^{j\varphi_1}$ and $e^{j\varphi_2}$.

The metasurface cells may advantageously be rectangular. The metasurface S1 may therefore consist of a plurality of rows RA of metasurface cells MS.

Figure 4:
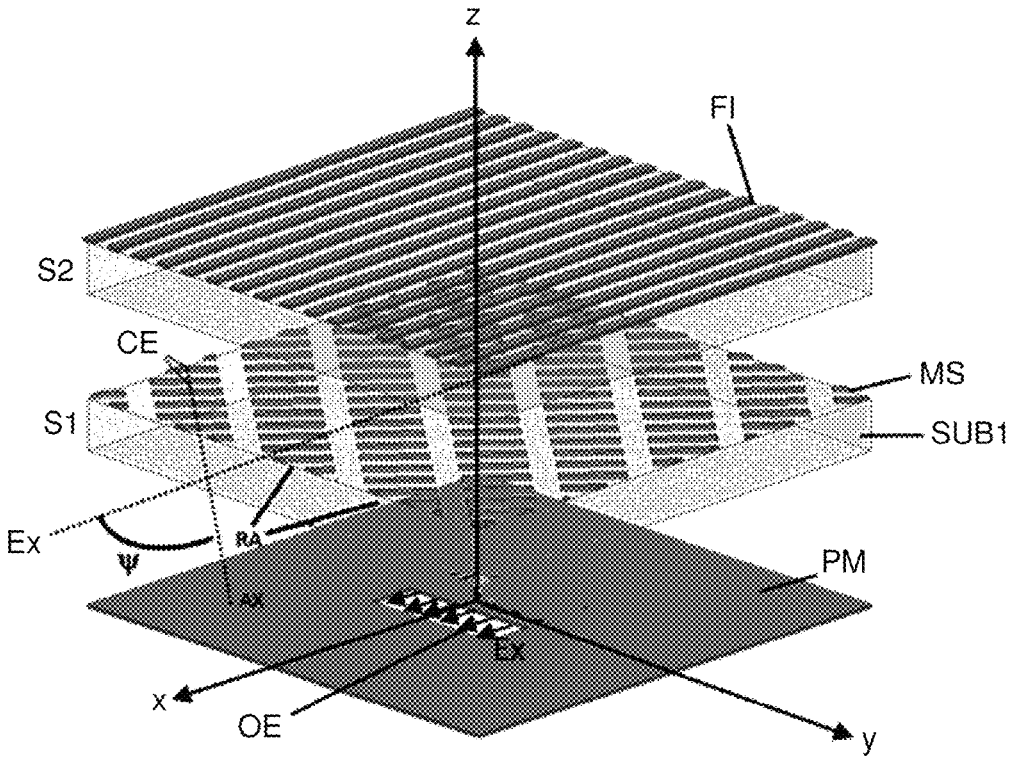
FIG. 4, a perspective view of mutually isolated metasurface cells, more particularly illustrating the orientation of the alignment axis of the metasurface cells with respect to the excitation polarization.

As illustrated in FIG. 4, the metasurface cells MS of a given row RA are isolated from one another, and placed on a substrate SUB1. These elements are placed between the ground plane through which the excitation aperture passes and the frequency selective surface S2. Each metasurface cell MS therefore forms a dipole, having a mainly capacitive behaviour with respect to the excitation polarization Ex and to the orthogonal polarization Ey. All the centres CE of the metasurface cells MS are aligned along an alignment axis AX. The alignment axis AX is therefore oriented with the angle Ψ with respect to the excitation polarisation Ex.

The metasurface cells MS may all have the same length (dimension ly in FIG. 3), and there may be the same spacing between two metasurface cells MS (dimension px in FIG. 3).

Figure 5:
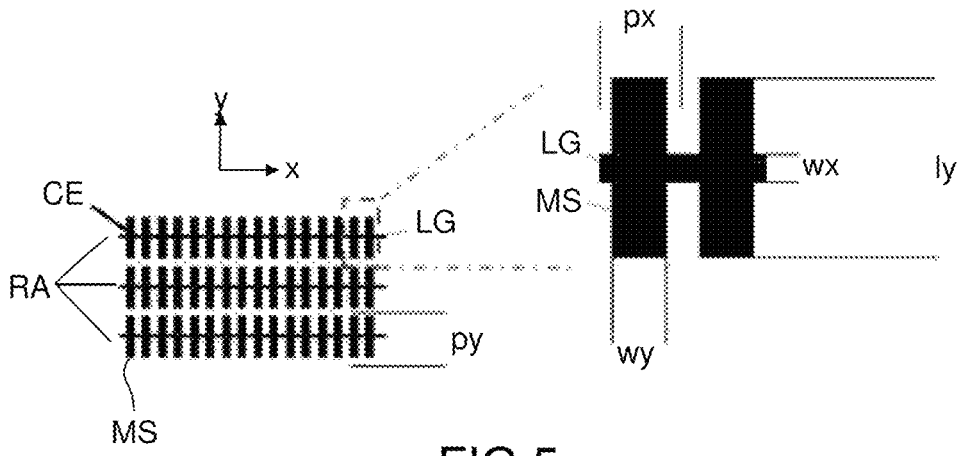
FIG. 5, an overview and a detail view, in the xy plane, of a plurality of rows of metasurface cells of the metasurface, said cells being connected by an interconnect line.

According to one variant, illustrated in FIG. 5, the metasurface S1 may comprise metasurface interconnect lines LG. The metasurface interconnect lines LG connect to one another all the metasurface cells MS of a given row RA. They advantageously allow electrostatic charge present on the metasurface cells MS to be evacuated, and thus improve the overall behaviour of the radiating element. The metasurface cells MS have properties in incidence that are remarkably stable, because particularly small features may be used, in order to obtain wideband or even bi-band characteristics. The metasurface cells MS of a given row RA are coupled in their centre CE, orthogonally, to a metasurface interconnect line LG.

Figure 6:
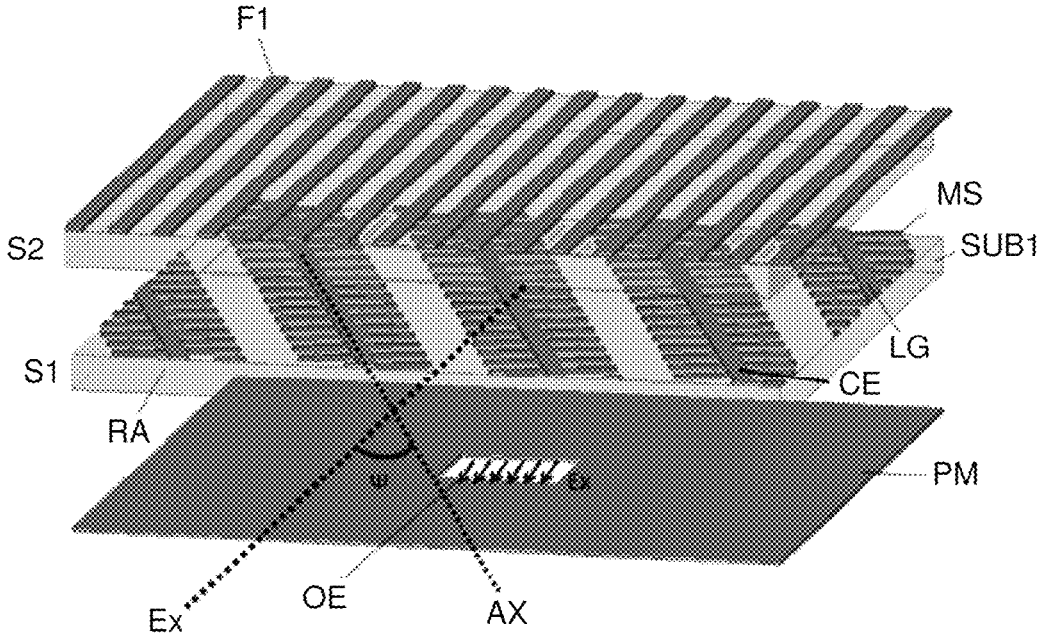
FIG. 6, a perspective view of metasurface cells coupled to one another by an interconnect line.

As illustrated in FIG. 6, the metasurface interconnect line LG is oriented by the angle Ψ with respect to the excitation polarisation Ex. For each row RA, the assembly formed by the interconnect line LG and by the metasurface cells MS therefore forms a grid of stubs (or matching elements). The grid of stubs has a behaviour that is mainly inductive with respect to the excitation polarization Ex, and capacitive with respect to the orthogonal polarization Ey.

The frequency selective surface S2, which is partially reflective, consists of an array of metal wires FI that are periodically spaced and that are oriented according to the excitation polarization Ex. As a variant, the frequency selective surface S2 may consist of slot or patch dipoles. The slots may be produced in a metal plate, and the patches placed on an electrically transparent substrate.

The array of metasurface cells MS is placed on a substrate SUB1, itself placed on a ground plane PM. The ground plane PM is passed through by the excitation aperture OE. The substrate SUB1 may for example be composed of a layer of nidaquartz sandwiched between two layers of Astroquartz™.

Figure 7:
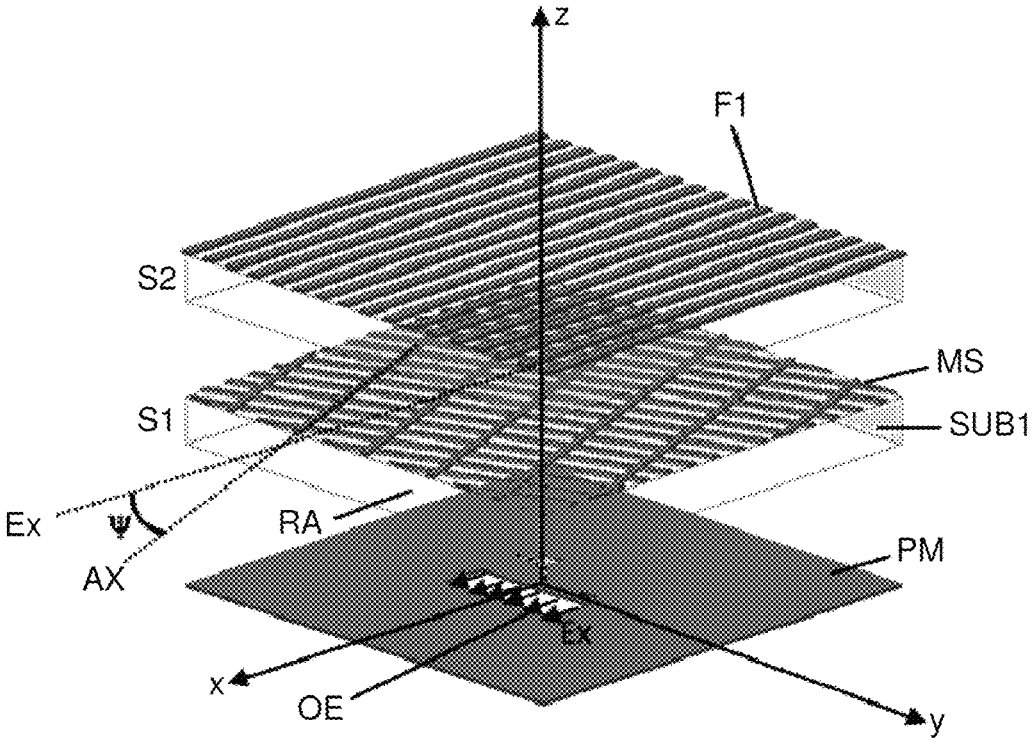
FIG. 7, a perspective view of metasurface cells forming a rectangular grid.

According to one variant, illustrated in FIG. 7, the rows RA are connected to one another by way of metasurface cells MS. They thus form with the metasurface interconnect lines LG a rectangular grid. The metasurface S1 thus has an inductive behaviour with respect to the excitation polarization Ex and to the orthogonal polarization Ey.

Figure 8:
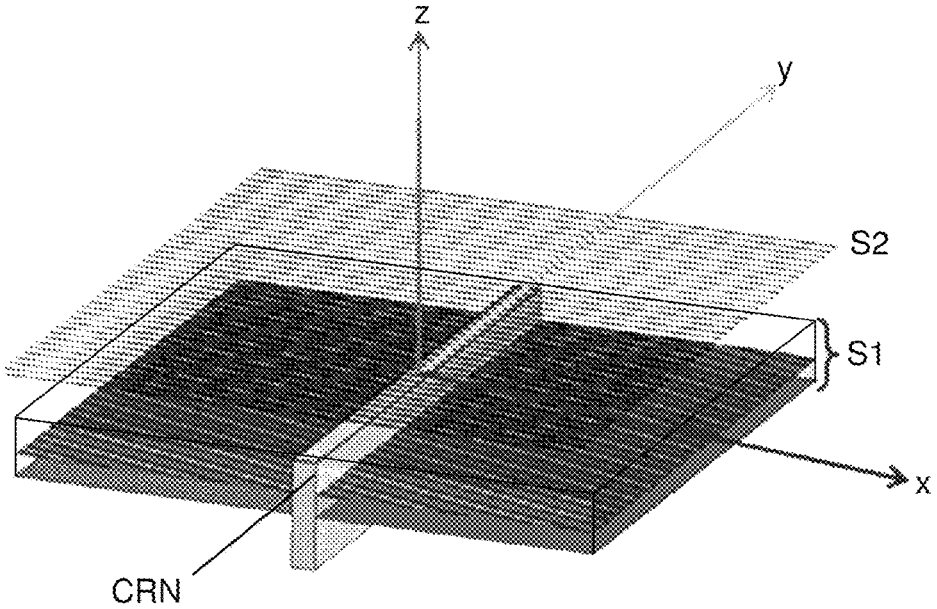
FIG. 8, an application of the radiating element according to the invention, in which the excitation aperture is a horn having a linear radiating aperture.

FIG. 8 illustrates the case where the excitation aperture OE is a horn CRN of a linear radiating aperture. The linear radiating aperture, which passes through the metasurface S1 and opens into the cavity, may be the radiating portion of a quasi-optical beamformer (characterized in particular by a large lateral aperture). This solution therefore allows a large spectral aperture to be preserved, while nonetheless producing a circularly polarized emission. The larger the size of the linear radiating aperture, the narrower the matching or emission passband. This however has no influence on the quality of the circular polarization, as indicated by relationship (16).

Figure 9:
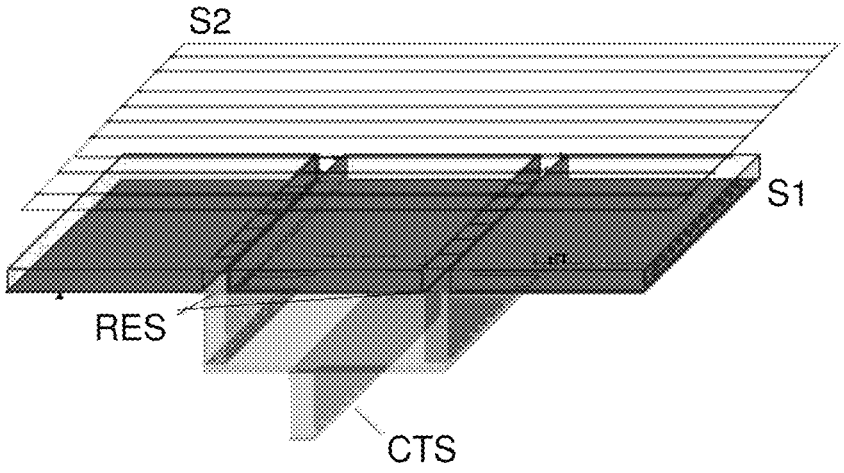
FIG. 9, an application of the radiating element according to the invention, in which the excitation apertures are an array of linear radiating apertures.

FIG. 9 illustrates the case where there is a plurality of excitation apertures OE. The excitation apertures OE are formed by an array RES of linear radiating apertures, issuing for example from a parallel-plate divider. The use of a parallel-plate divider in particular allows the field to be better distributed over the excitation apertures OE. In order to limit coupling between the linear radiating apertures, it is recommended to greatly limit coupling between their accesses, for example to −15 dB.

Figure 10A:
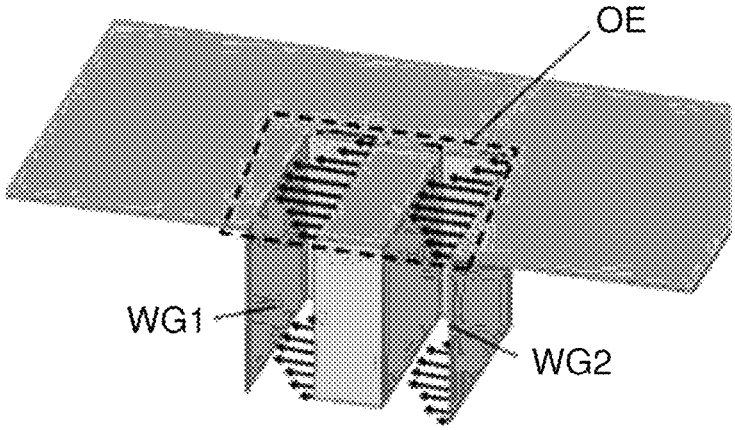
FIGS. 10A, 10B and 10C, an embodiment in which the excitation aperture comprises a dual feed.
Figure 10B:
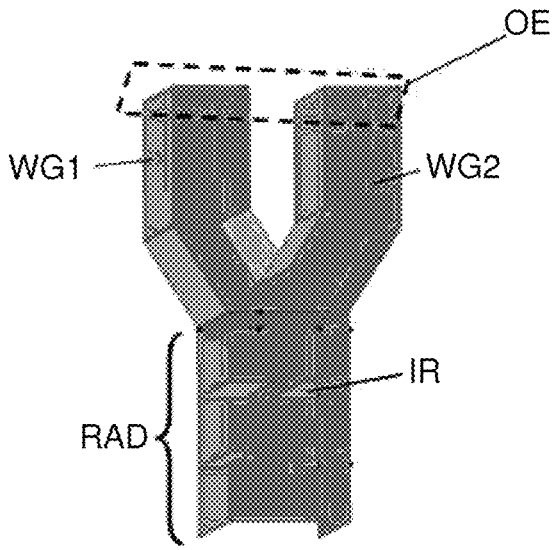
Figure 10C:
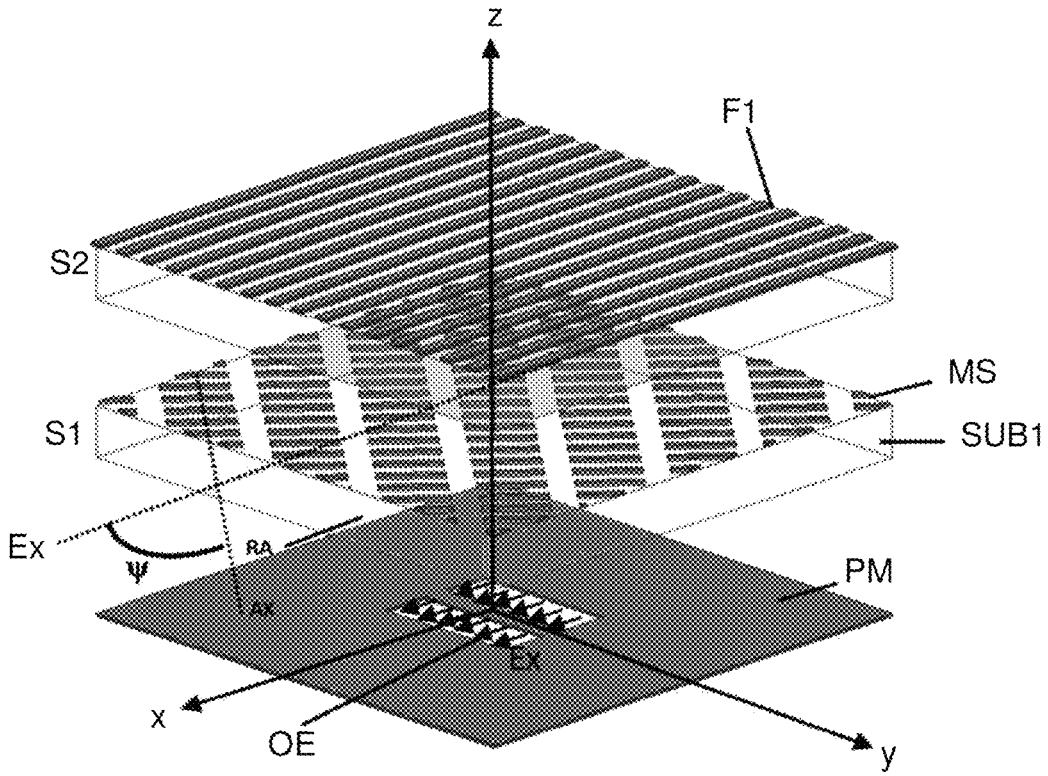

FIGS. 10A, 10B and 10C illustrate one embodiment of the invention, in which the excitation aperture OE is dual. It comprises a dual feed formed by two waveguide apertures (WG1, WG2) that open symmetrically into the resonant cavity, and that are connected to an impedance matching network RAD. The impedance matching network RAD comprises at least one iris IR, in order to widen the matching band. This embodiment allows a parasitic TEM mode that could potentially be present in the radiating element to be cancelled out. This TEM mode, which generates crossed polarization lobes, is independent of the type of excitation aperture OE. FIG. 10C illustrates such an excitation aperture, integrated into a radiating element according to the invention. In FIG. 10C, each metasurface cell MS forms a dipole, with no interconnect line. A dual excitation aperture may be achieved in the same way when the metasurface cells MS are connected by an interconnect line, or when they form a rectangular grid.

Figure 11A:
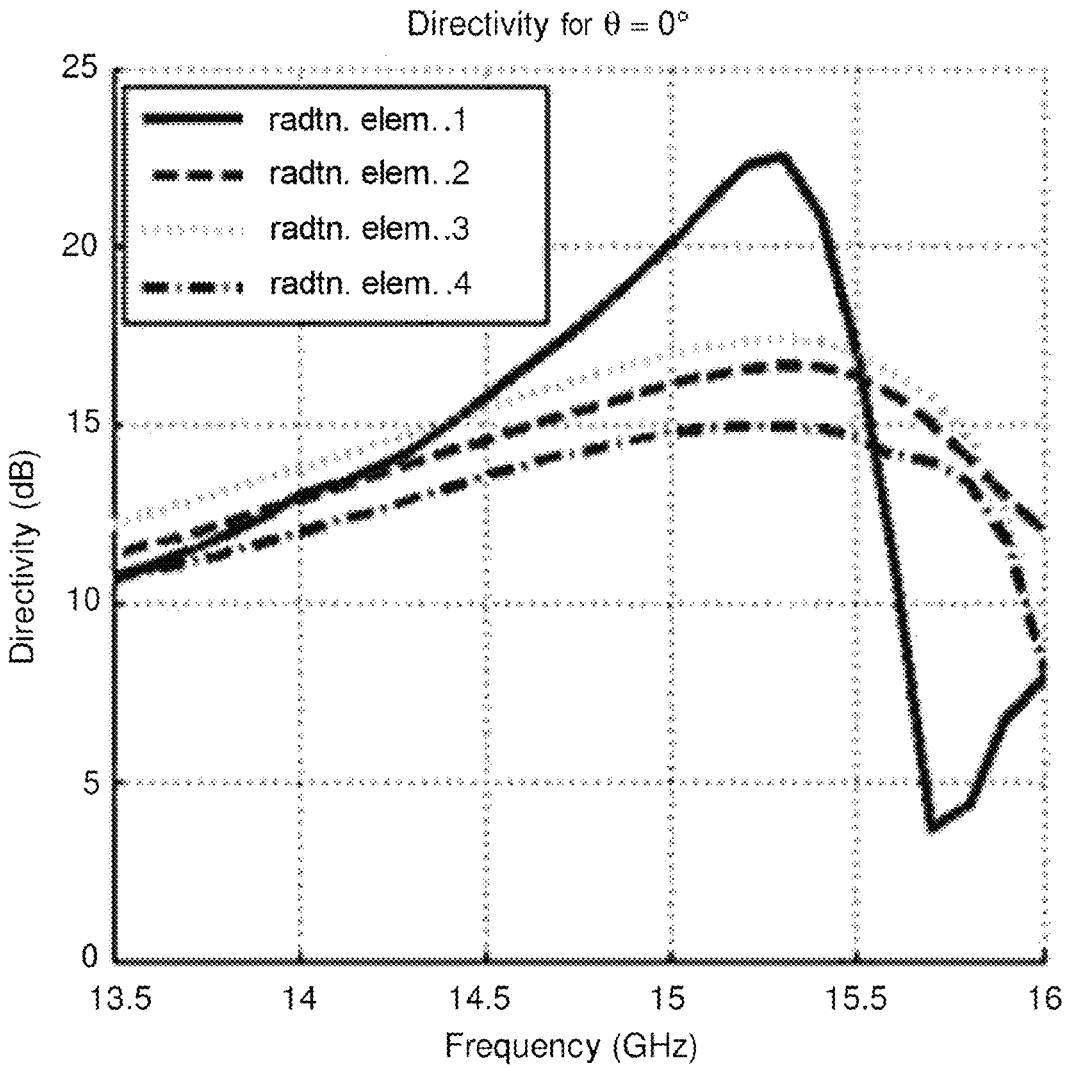
FIGS. 11A and 11B, curves illustrating the directivity and axial ratio as a function of frequency, for a number of radiating-element configurations.
Figure 11B:
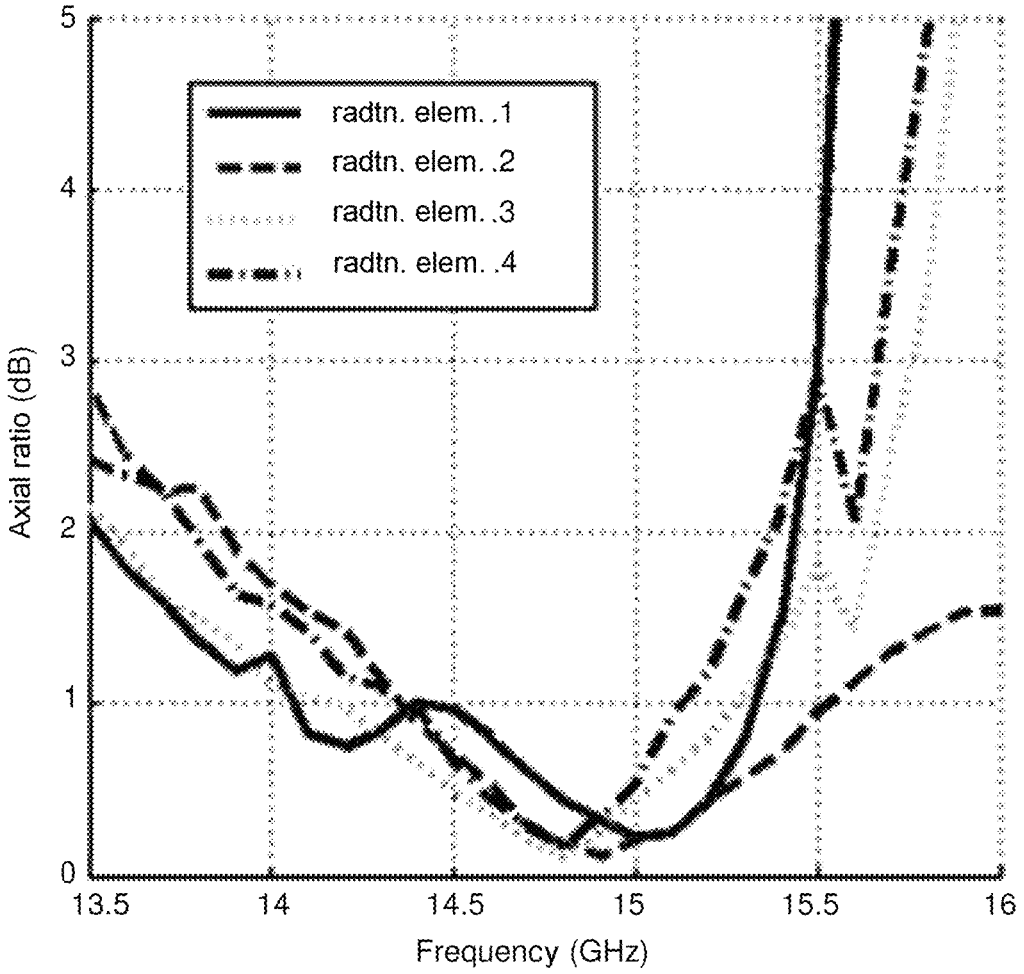

FIGS. 11A and 11B illustrate the frequency behaviour of the directivity and axial ratio of a plurality of antennas integrating radiating elements according to the invention, and comprising a dual feed formed by two waveguide apertures, according to the embodiment described above. The radiating elements differ in differing values of the width (a) and of the length (b) of the excitation aperture, and differing values of the reflection coefficient $r_{2x}$. The values of the reflection coefficient $r_{2x}$ are denoted "+", "++" or "+++" in order to indicate their relative value.

| | a (mm) | b (mm) | Reflectivity of the frequency selective surface S2 |
|---|---|---|---|
| Radiating element 1 | 5 | 15 | +++ |
| Radiating element 2 | 5 | 15 | ++ |
| Radiating element 3 | 10 | 15 | ++ |
| Radiating element 4 | 10 | 15 | + |

FIG. 11A illustrates the frequency behaviour of the directivity of the radiating elements, for an angle θ=0°. The more directive the radiating element (and therefore the higher the reflectivity of the frequency selective surface S2), the less the frequency behaviour is wideband, this being typical of Fabry-Perot cavity antennas. For radiating elements 2, 3 and 4, the bandwidth at −3 dB is about 10% of the central frequency. FIG. 11B illustrates the frequency behaviour of the axial ratio of the radiating elements, for an angle θ=0°. The bandwidth at −3 dB is larger than 10% for the four antennas, and remains about 10% at −1 dB, this being clearly better that the performance of prior-art radiating elements. As demonstrated by relationship (16), the technique for generating the circular polarization works over a large passband and does not limit the operation of the radiating element.

The wideband behaviour may be even further improved by arranging a second cavity in cascade on the frequency selective surface S2. To achieve this cascade arrangement, at least one second resonant cavity is placed on the cavity that is the subject of the invention. The second resonant cavity has as lower surface the frequency selective surface of the lower cavity, and as upper surface a partially reflective surface. The transverse cross section of the upper cavity may be larger than that of the lower first cavity, as described in document FR2959611, or, alternatively, its transverse cross section may be substantially identical to that of the lower cavity. This so-called "two-cavity" embodiment makes it possible to decrease the reflectivity of the frequency selective surface of the lower cavity, this promoting the wideband behaviour of the radiating element, without however having an influence on the quality of the circular polarization.

The invention claimed is:

1. A circularly polarized radiating element comprising:

at least one excitation aperture for a wave that is linearly polarized with what is referred to as an excitation first polarization; and a frequency selective surface that partially reflects the excitation polarization and that is transparent to a second polarization, referred to as the orthogonal polarization, that is orthogonal to the excitation polarization and to the direction of propagation of the wave, said surface being placed in a plane defined by the excitation polarization and by the orthogonal polarization;

wherein it further comprises a completely reflective metasurface facing the frequency selective surface, and comprising a two-dimensional and periodic array of conductive planar elements forming metasurface cells, the excitation aperture opening onto the metasurface, the frequency selective surface and the metasurface forming a resonant cavity for the excitation polarization, the metasurface cells all being oriented identically with respect to the excitation polarization and configured to: reflect an incident wave having the excitation polarization in order to form a reflected wave polarized with the excitation polarization, and depolarize and reflect the incident wave in order to form a reflected wave polarized with the orthogonal polarization, having a phase difference substantially equal to ±90° with respect to the reflected wave polarized with the excitation polarization, and having an amplitude substantially equal to the amplitude of a wave radiated by the frequency selective surface, generated from the reflected wave polarized with the excitation polarization.

2. The radiating element according to claim 1, the metasurface comprising a ground plane on which are placed a substrate and the array of metasurface cells, which cells are arranged in rows, the centres center of each metasurface cell of a given row being aligned along an alignment axis, the alignment axis being oriented by a rotation angle (ψ) with respect to the excitation polarization, the rotation angle (ψ) being defined so as to make the matrix [S'] diagonal, where:

$$[S'] = {}^{t}[R][S][R],$$

[S] being the scattering matrix of the metasurface (S1), and [R] the rotation matrix of a rotation of angle ψ.

3. The radiating element according to claim 2, the metasurface cells of a given row being coupled by a metasurface interconnect line that is elongate along the alignment axis.

4. The radiating element according to claim 3, the rows being connected to one another by way of metasurface cells, forming with the metasurface interconnect lines a rectangular grid.

5. The radiating element according to claim 2, the metasurface cells of a given row being mutually isolated.

6. The radiating element according to claim 2, the metasurface cells of a given row all being periodically spaced.

7. The radiating element according to claim 2, all the metasurface cells of the metasurface having the same dimensions.

8. The radiating element according to claim 1, the frequency selective surface comprising an array of parallel metal wires that are periodically spaced and aligned with the excitation polarization.

9. The radiating element according to claim 1, the frequency selective surface comprising a two-dimensional array of metal dipoles that are arranged periodically.

10. The radiating element according to claim 1, the excitation aperture comprising at least one waveguide aperture opening into the resonant cavity.

11. The radiating element according to claim 10, the excitation aperture comprising a dual feed formed by two waveguides that open symmetrically into the resonant cavity, and that are connected to an impedance matching network.

12. The radiating element according to claim 1, the excitation aperture being a horn of a linear radiating aperture.

13. The radiating element according to claim 1, comprising a plurality of excitation apertures, the excitation apertures being formed by an array of linear radiating apertures.

14. The radiating element according to claim 1, comprising at least one second cavity arranged in cascade on the frequency selective surface.

15. The radiating element according to claim 1, the metasurface cells being of rectangular shape.

16. An array antenna comprising at least one radiating element according to claim 1.

* * * * *